US007196298B2

(12) United States Patent
Åkerlind

(10) Patent No.: US 7,196,298 B2
(45) Date of Patent: Mar. 27, 2007

(54) DEVICE FOR ACHIEVING A TEMPERATURE CONTROLLED HEATING OF SOLID FOOD BY INDICATING A TEMPERATURE CHANGE OF THE SOLID FOOD CAUSED BY MICROWAVE HEATING

(75) Inventor: Jan Åkerlind, Stockholm (SE)

(73) Assignee: Real Food Sweden AB, Stockholm (SE)

( * ) Notice: Subject to any disclaimer, the term of this patent is extended or adjusted under 35 U.S.C. 154(b) by 0 days.

(21) Appl. No.: 11/328,025

(22) Filed: Jan. 9, 2006

(65) Prior Publication Data

US 2006/0113299 A1 Jun. 1, 2006

Related U.S. Application Data

(63) Continuation of application No. PCT/SE04/001101, filed on Jul. 5, 2004.

(51) Int. Cl.
*H05B 6/68* (2006.01)
*F24C 7/02* (2006.01)
*H05B 6/80* (2006.01)

(52) U.S. Cl. ..... 219/710; 219/720; 219/734; 219/506; 116/216; 426/88; 99/DIG. 14; 374/149

(58) Field of Classification Search ..... 219/710–714, 219/720, 725, 734, 506, 494; 116/216; 426/88; 99/325, 451, DIG. 14; 374/149, 150
See application file for complete search history.

(56) References Cited

U.S. PATENT DOCUMENTS 4,871,891 A * 10/1989 Steers et al. ..... 219/710
4,933,525 A * 6/1990 St. Phillips ..... 219/725
5,504,311 A 4/1996 DuBuis et al.
5,994,677 A * 11/1999 Akerlind ..... 219/710
2003/0075538 A1 4/2003 Kish et al.

FOREIGN PATENT DOCUMENTS

GB 2318884 A 5/1998
GB 2326954 A 1/1999

OTHER PUBLICATIONS

Advertisement from Internet; Reusable Color-Changing Thermometer; info@grill-perfect.com; last update Apr. 12, 2003.

* cited by examiner

*Primary Examiner*—Philip H. Leung
(74) *Attorney, Agent, or Firm*—Frishauf, Holtz, Goodman & Chick, P.C.

(57) ABSTRACT

A device is provided for temperature controlled heating of primarily solid food in a microwave oven, which includes a block of polymeric material which is thermally insulated with respect to the food and which is provided so as to be exposed to a same microwave radiation as the food. A heat sensitive, readable marking which corresponds to a temperature of the food is provided on a surface of the block of polymeric material. A reader is connected to a heating system of the oven, and reads the marking and transmits control signals to a control circuit for controlling the heating system of the oven, when the reader reads a change of the marking.

18 Claims, 2 Drawing Sheets

DEVICE FOR ACHIEVING A TEMPERATURE CONTROLLED HEATING OF SOLID FOOD BY INDICATING A TEMPERATURE CHANGE OF THE SOLID FOOD CAUSED BY MICROWAVE HEATING

CROSS REFERENCE TO RELATED APPLICATIONS

This application is a continuation application of International Application PCT/SE2004/001101 filed Jul. 5, 2004, which claims priority of Swedish patent application No. 0302030-2 filed Jul. 7, 2004, the entire contents of both of which are incorporated herein by reference

FIELD OF THE INVENTION

The present invention relates to a device for achieving temperature controlled heating of primarily solid food in a microwave oven, whereby a heat sensitive, readable marking is provided which corresponds to the temperature of the food and which is positioned in the oven such that it is readable by a reader connected to the heating system of the oven. When the temperature of the food changes, the reader reads changes of the marking and transmits control signals to a control circuit for controlling the heating system of the oven.

BACKGROUND OF THE INVENTION

Numerous variants of devices of this type are conventionally known. For example, devices have conventionally been provided with temperature sensitive markings in the form of bar codes, which make it possible to transfer a wide variety of information concerning not only a heating program and temperature conditions, but also previous temperature related handling of packages with food.

The known devices have proved to work sufficiently with packages containing fluid food, where the read temperature on the surface of the package closely follows the temperature of the contents of the package. Packages containing predominantly solid food, however, are subject to a considerable delay with respect to the determined temperature on the surface of the package compared to the temperature within the food. There are also other irregularities depending on the kind of food in the package.

OBJECT OF THE INVENTION

The object of the invention is to provide a device for achieving temperature controlled heating of food in a microwave oven, whereby a heat sensitive, readable marking is provided which reflects the temperature of the food and which is positioned in the oven such that it is readable by a reader connected to the heating system of the oven, which also easily and reliably works with food consisting of solely or mainly solid food.

SUMMARY OF THE INVENTION

To achieve the object of the invention, a device is provided for achieving temperature controlled heating of food in a microwave oven, wherein the device includes a block of polymeric material which is thermally insulated with respect to the food and which is provided so as to be exposed to a same microwave radiation as the food; a heat sensitive, readable marking which is provided on a surface of the block of polymeric material, and which corresponds to a temperature of the food; and a reader which is connected to a heating system of the oven, and which reads the marking and transmits control signals to a control circuit for controlling the heating system of the oven, when the reader reads a change of the marking.

BRIEF DESCRIPTION OF THE DRAWINGS

The invention is described in more detail in the following with reference to the attached drawings, which schematically disclose an example of an embodiment of the device according to the present invention, and in which.

DETAILED DESCRIPTION

Figure 1:
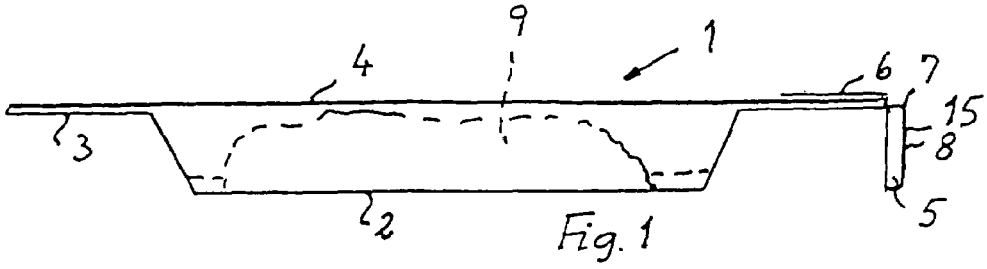
FIG. 1 is a short side view of a package containing food, which package is designed as a plate.
Figure 2:
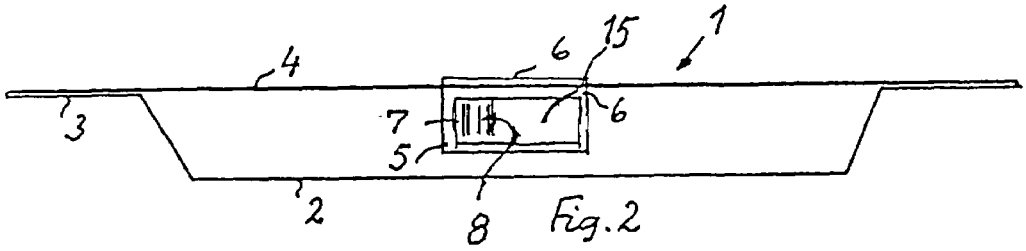
FIG. 2 is a long side view of the same plate.
Figure 3:
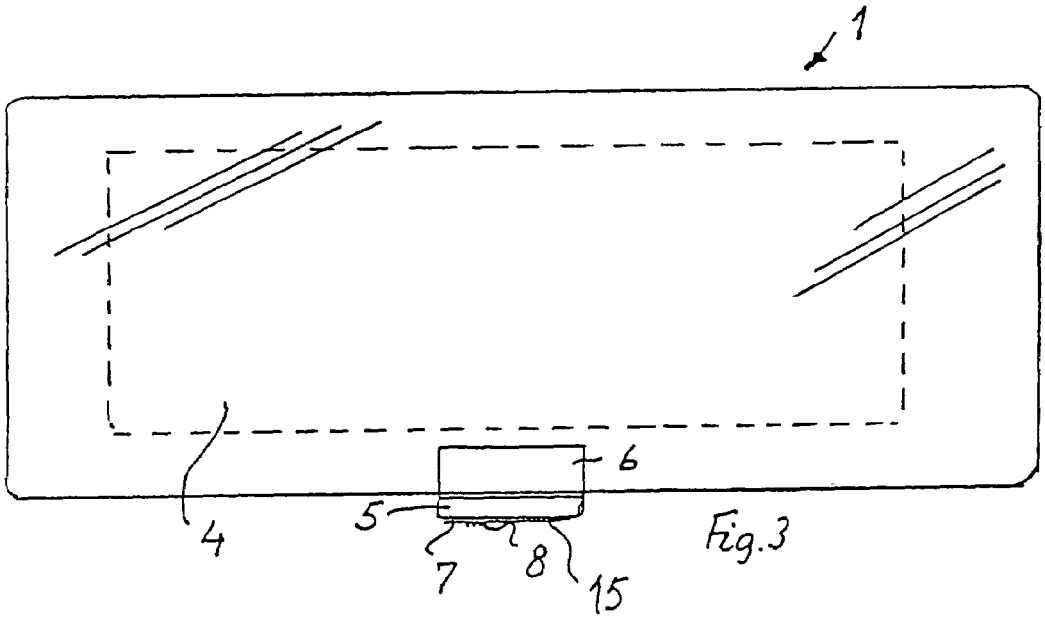
FIG. 3 is a plan view of the plate.

The package shown in FIGS. 1–3 is in the shape of a long and narrow plate 1 and has a cup-shaped part 2 with a planar upper protruding brim 3. The package is sealed by a membrane 4 and contains a predominantly solid food product 9 marked with dashed lines. In the middle of the long side of the plate there is a small block (or plate) 5 of polymeric material which freely hangs down from the brim 3 and is attached to the package by an adhesive tape 6 that is pressed against the upper side of the brim 3. A bar code 8 is printed in black color on a self-adhering label 7 which is attached to the outwardly directed side of the polymeric block 5. A part of the label 7 is also provided with a marking 15 consisting of thermochromatic color that changes color at a predetermined temperature. Said part of the label 7 may alternatively be transparent, and the marking 15 may be placed directly on the surface of the block 5 beneath said transparent part of the label 7.

The bar code 8 may of course be printed directly on the surface of the block 5, in which case the label 7 is superfluous. According to a small-scale application of the present invention, moreover, polymeric blocks may be provided with adhesive tapes with accompanying bar codes for different applications. Alternatively, separate, transparent and self-adhering labels with bar codes may be attached on polymeric blocks.

Figure 4:
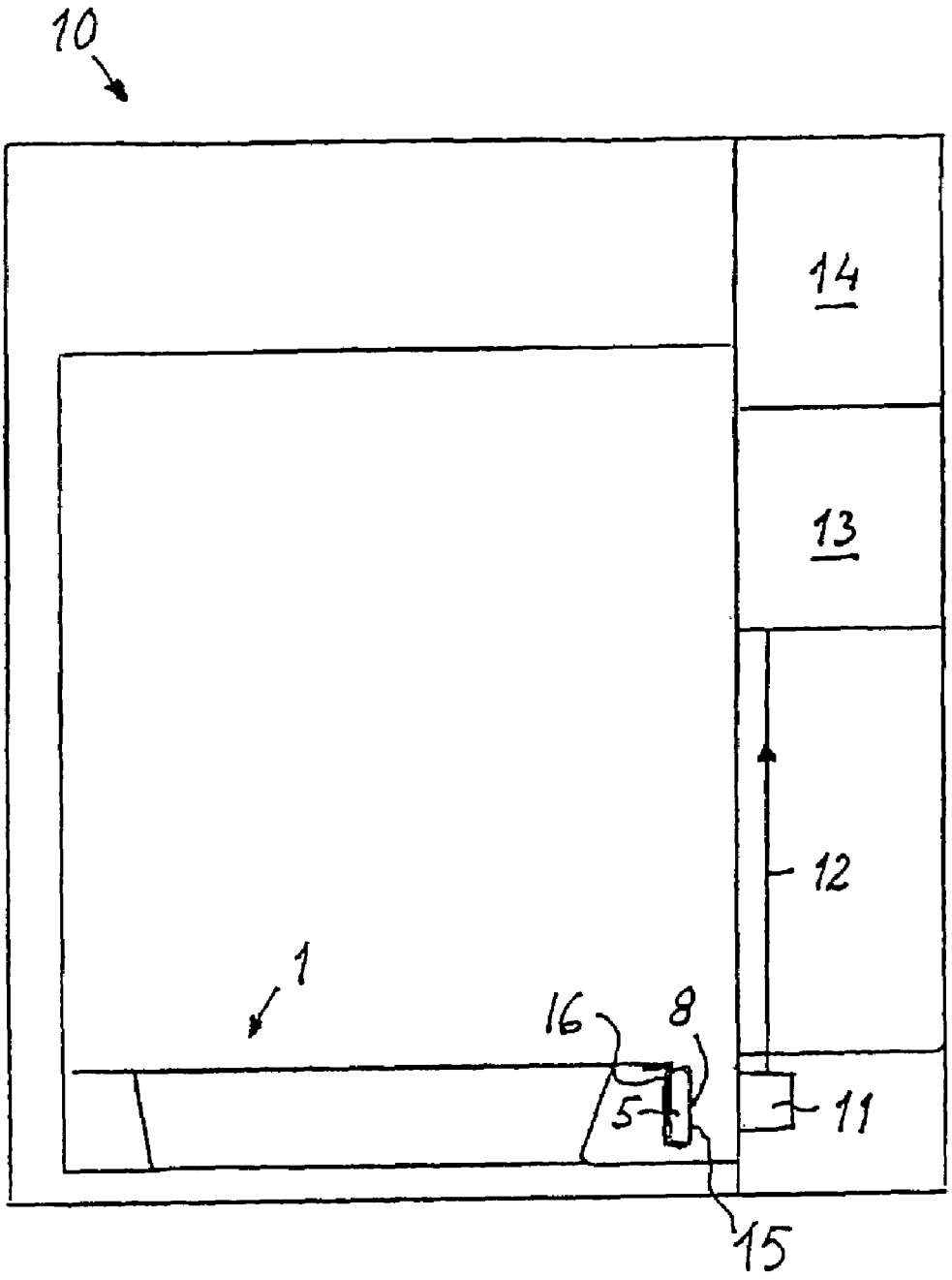
FIG. 4 is a front view of a microwave oven shown with a food package placed in the oven.

The polymeric block 5 may for practical reasons be turned towards the under side of the brim 3 before the heating of the package and turned to the position shown on the drawings when the package is introduced into the oven. As shown in FIG. 4, the package 1 may be provided with a holder 16 in which the block 5 may be placed. Such a holder 16 may of course be positioned in the oven 10 at a place where the block 5, when placed in the holder 16, is exposed to the same microwave radiation as the food in the package 1 (not shown).

In order to heat a package in the shape of the shown plate 1, it is placed in a microwave oven 10 with the marking 15 placed in front of a reader 11, which at reading the marking delivers control signals via a line 12 to a control circuit 13. The control circuit 13 is arranged to control the heating system 14 of the oven 10 according to a conventional method based on the read information, which also may include the bar code 8 (See FIG. 4).

According to the present invention, if the package inserted into the oven 10 has a deep-freeze temperature then the polymeric block 5 will also have the deep-freeze temperature so as to cause the heating time to be automatically extended. Alternatively, if the package has a refrigerator temperature then the heating time will be shorter, and the heating time will be further shortened if the package has been kept at room temperature so that the food in the package and the polymeric block have assumed a temperature close to room temperature.

Polymeric material of the kind used in the present invention is commercially available and is obtainable with a broad dielectric constant spectrum, which as is well known determines the degree of heating of the polymeric material by microwaves. It is therefore possible to proceed by trial and error to determine appropriate polymeric materials for different kinds of solid food products. To determine the appropriate polymeric materials for particular food types, the polymeric materials are heated by microwaves while the temperature in the food is measured. A calibration is carried out with respect to the heating of different tested polymeric blocks in dependence on the value of the dielectric constant of the different polymeric blocks, which are exposed to the same microwave radiation as the food but are kept insulated with respect of the food. In this way a correlation or correspondence is achieved between the temperature of the food and the temperature of the polymeric block. A temperature dependant marking can be indicated on the surface of the polymeric block, which indication can be utilized for controlling the heating program of the oven.

Independently of the temperature dependant marking, a special, known marking may also be positioned on the surface of the block, which consists of a typical bar code for identifying the kind and price of the food, and so on.

It is especially advantageously if the polymeric material has such a composition that it simultaneously and closely follows the heating progress of the food.

The polymeric material may be at least partly transparent and the marking may be composed of thermochromatic colour pigments embedded in the block, which gradually change colour and/or colour intensity in response to temperature changes inside the block. These changes are readable on the surface of the block.

A number of alternative blocks of polymeric material may be available as accessories to a microwave oven. The alternative blocks preferably have different dielectric constants that match different standardized food products. One of the different blocks which corresponds to the kind of food product may be selected and placed at a predetermined place, suitably marked by a holder for the block on the food or, if the food is provided with a surrounding package, on the package, before the food or the package is introduced to a predetermined place in the oven. As an alternative such a holder may be positioned directly in the oven at a place where the block will be exposed to the same microwave radiation as the food placed in the oven. In this way alternative degrees of cooking food may be possible, for instance more or less roasted.

Since a polymeric block attached to a food product or a package must not be influenced by the temperature of the food, the polymeric block is suitably hinged to the package such that the block may be folded outwards from the package to a position distant from the surface of the food or package. As an alternative, the polymeric block may be arranged to hang down freely from a protruding edge of a package enclosing the food.

The invention is of course not limited to the embodiment shown and described by way of example but can be modified in different ways within the scope of the invention defined by the patent claims. Accordingly, in more uncomplicated applications it is possible to use a marking designed as a restricted area of the polymeric block, which only indicates that a certain temperature is reached, at which the oven is shut off. In this case the reader is a device for IR-reading.

What is claimed is:

1. A device for achieving temperature controlled heating of food in a microwave oven, comprising:

a block of polymeric material which is thermally separated with respect to the food and which is coupled to the food so as to be exposed to a same environment temperature and microwave radiation as the food; and a heat sensitive, readable marking comprising a thermochromatic color pigment which is adapted to be visible on a surface of the block of polymeric material so as to correspond to a temperature of the food.

2. The device according to claim 1, further comprising a reader which is connected to a heating system of the oven, and which reads the marking and transmits control signals to a control circuit for controlling the heating system of the oven, when the reader reads a change of the marking.

3. The device according to claim 2, wherein the block of polymeric material has a composition such that a temperature of the polymeric material changes with a change in temperature of the food.

4. The device according to claim 3, wherein the block of polymeric material is at least partially transparent; and wherein the thermochromatic color pigment is embedded in the block of the polymeric material, and at least one of a color and a color intensity of the thermochromatic color pigment changes in response to a temperature change.

5. The device according to claim 3, wherein the polymeric material is selected from a group of polymeric materials each having a different dielectric constant.

6. The device according to claim 3, wherein the reader comprises an IR-reader for determining a temperature of the marking.

7. The device according to claim 2, wherein the block of polymeric material is at least partially transparent; and wherein the thermochromatic color pigment is embedded in the block of the polymeric material, and at least one of a color and a color intensity of the thermochromatic color pigment changes in response to a temperature change.

8. The device according to claim 2, wherein the polymeric material is selected from a group of polymeric materials each having a different dielectric constant.

9. The device according to claim 2, wherein the block of polymeric material is hinged to a package enclosing the food such that the block of polymeric material is adapted to be folded outward from the package to a position away from a surface of the package.

10. The device according to claim 2, wherein the block of polymeric material freely hangs down from a protruding edge of a package enclosing the food.

11. The device according to claim 2, wherein the reader comprises an IR-reader for determining a temperature of the marking.

12. The device according to claim 1, wherein the block of polymeric material has a composition such that a temperature of the polymeric material changes with a change in temperature of the food.

13. The device according to claim 12, wherein the block of polymeric material is at least partially transparent; and wherein the thermochromatic color pigment is embedded in the block of the polymeric material, and at least one of a color and a color intensity of the thermochromatic color pigment changes in response to a temperature change.

14. The device according to claim 12, wherein the polymeric material is selected from a group of polymeric materials each having a different dielectric constant.

15. The device according to claim 1, wherein the block of polymeric material is at least partially transparent; and wherein the thermochromatic color pigment is embedded in the block of the polymeric material, and at least one of a color and a color intensity of the thermochromatic color pigment changes in response to a temperature change.

16. The device according to claim 1, wherein the polymeric material is selected from a group of polymeric materials each having a different dielectric constant.

17. The device according to claim 1, wherein the block of polymeric material is hinged to a package enclosing the food such that the block of polymeric material is adapted to be folded outward from the package to a position away from a surface of the package.

18. The device according to claim 1, wherein the block of polymeric material freely hangs down from a protruding edge of a package enclosing the food.

* * * * *